US005110227A

United States Patent [19]

Hatakeyama et al.

[11] Patent Number: 5,110,227

[45] Date of Patent: May 5, 1992

[54] COLOR PRINTER

[75] Inventors: Atsushi Hatakeyama, Tokyo; Tsutomu Miura, Kanagawa; Wayne F. Niskala, Tokyo; Tomonori Sato; Masamichi Yumino, both of Kanagawa, all of Japan

[73] Assignee: Eastman Kodak Co., Rochester, N.Y.

[21] Appl. No.: 648,455

[22] Filed: Jan. 30, 1991

[30] Foreign Application Priority Data

Apr. 2, 1990 [JP] Japan ..... 2-88582

[51] Int. Cl.[5] ..... B41J 11/48

[52] U.S. Cl. ..... 400/120; 400/593; 400/594; 400/617; 400/618; 226/143

[58] Field of Search ..... 400/120, 234, 236, 240–240.4, 400/586, 587, 593, 594, 594.1, 608.3, 611, 617, 618, 619; 226/143

[56] References Cited

U.S. PATENT DOCUMENTS

| | | | |
|---|---|---|---|
| 4,391,539 | 7/1983 | Connoy | 400/618 |
| 4,639,739 | 1/1987 | Tsutsumi | 400/593 |
| 4,881,831 | 11/1989 | Takita et al. | 400/617 |
| 4,953,994 | 9/1990 | Shiozaki et al. | 400/608.3 |
| 4,999,649 | 3/1991 | Saji et al. | 400/617 |

FOREIGN PATENT DOCUMENTS

| | | | |
|---|---|---|---|
| 3230258 | 2/1984 | Fed. Rep. of Germany | 400/618 |
| 0576780 | 11/1982 | Japan | 400/617 |
| 0215873 | 12/1984 | Japan | 400/608.3 |
| 0214465 | 9/1988 | Japan | 400/618 |
| 2171082 | 8/1986 | United Kingdom | 400/617 |

*Primary Examiner*—Eugene H. Eickholt
*Attorney, Agent, or Firm*—Raymond L. Owens

[57] ABSTRACT

A color printer according to the present invention includes a clutch means, an urging member and a positional alignment mechanism. The clutch means is used for engaging and disengaging a driving force used to move a paper holder means. The urging member (e.g., a spring) is used to urge the paper holder means in a direction opposite to the printing direction. The positional alignment mechanism is used for mechanically determining the position at which printing is to start on the paper when the paper holder means is disengaged from the driving force by the clutch means and is urged by the urging member in the direction opposite to the printing direction.

21 Claims, 6 Drawing Sheets

COLOR PRINTER

FIELD OF THE INVENTION

The present invention relates to a color printer in which heat from a thermal printer head is used to transfer ink to a print medium such as paper, and, more particularly, the present invention relates to a color printer which uses prescribed reciprocal movement of the print medium to perform the color printing.

DESCRIPTION OF THE PRIOR ART

In a color printer, a print medium as, for example, paper, and an ink transfer medium (hereinafter referred to as an "ink donor film") are passed between a thermal print head and a platen roller, and the thermal print head is heated to transfer the ink to the paper.

FIGS. 5, 6, and 7 illustrate a paper transport mechanism, and a paper position detection mechanism in a conventional color printer.

Referring now to FIG. 5, there is shown an example of a color printer which employs a reciprocating paper transport system. In FIG. 5, print paper 10 is pinched between a first and a second set of pinch rollers 12 and 14, respectively, and is moved backwards and forwards by the rotation of these sets of pinch rollers 12, 14. The rotation of the sets of pinch rollers 12 and 14 feeds the paper 10 through a gap between a platen roller 16 and a thermal print head 18 which constitutes a transfer section.

An ink donor film 20 is also fed through this transfer section, overlaying the paper 10. This ink donor film 20 is moved in unison with the movement of the paper 10 by film rollers 22 and 24. A guide shaft 26 guides the movement of the ink donor film 20. Heat generated by the thermal pain head 10 is used to selectively transfer ink from the ink donor film 20 to the paper 10 positioned between the platen roller 16 and the thermal print head 18.

A motor 28 is used to drive the paper transport system. The driving force of the motor 28 is transmitted to a pinch roller pulley 32 [with appropriate gearing (not shown)] and a platen roller pulley 34 such as by means of, for example, a belt mounted on a motor pulley 30. Thus, operating the motor 28 in the direction A-a rotates the pinch rollers 12 and 14 and the platen roller 16, thereby moving the paper 10 in the direction B-b. An edge sensor 36 detects the leading edge of the paper 10.

Referring now to FIGS. 6 and 7, there is shown a side view and a front view, respectively, of a color printer arrangement in which the paper 10 is moved in one direction only by a rotational mechanism. As shown, the platen roller (paper support means) comprises a platen drum 40. The platen drum 40 is provided with a gripper 42 which clamps the paper 10 onto the surface of the platen drum 40. Driving force is transmitted to the platen drum 40 by means of a belt 46 provided between the motor pulley 30 and a drum pulley 44. Also provided are a thermal print head 18, and film rollers 22 and 24 for transporting the ink donor film 20, as described in the prior art color printer of FIG. 5.

In the color printer thus constituted, the angle of rotation of the platen drum 40 and the leading edge of the paper 10 are detected by an optical encoder 12 (in FIG. 7) comprising a slit disk 48 and a photo-interrupter 50.

The conventional color printer arrangements described above have the following drawbacks. In the case of the reciprocating transport system illustrated in FIG. 5, the position at which printing of the paper 10 is started is determined on the basis of the position of the leading edge of the paper 10 as detected by edge sensor 36. However, the edge sensor 36 detects the leading edge of the paper 10 within a certain permissible range of error which prevents it from detecting slight deviations in the position at which printing of the paper 10 starts. In the case of the printing involving multiple passes, such as for color printing, the result is a lack of sufficient registration to produce correct color reproduction.

In the color printer arrangement shown in FIGS. 6 and in which the paper 10 is moved in one direction only by a rotational mechanism, an optical encoder 52 is used to detect the position at which printing starts. However, like the edge sensor 36 of FIG. 5 described above, the optical encoder 52 of FIG. 7 detects the angle of rotation of the platen drum 40 to within a certain permissible range of error, which prevents it from completely eliminating color deviations during color printing.

In addition, the stopping of the motor 28 is accompanied by a positional error which also produces a minute alteration of the position at which printing starts, which is also a cause of color deviation on the paper 10.

SUMMARY OF THE INVENTION

The drawbacks of the prior art systems described above are overcome by the present invention which relates to a color printer which enables easy and precise alignment of the position at which printing of the paper is to start.

More particularly, the present invention relates to a color printer comprising disengagement means for disengaging a driving force used to move a paper holder means; an urging member for urging the paper holder means in a direction opposite to that of the printing; and a positional alignment mechanism for mechanically determining the position at which printing is to start on the paper on the basis of contact made with the paper holder means when the paper holder means is disengaged from the driving force and is urged in the direction opposite to that of the printing. Preferably a clutch is used as the disengaging means.

With the color printer thus arranged, at the point where printing is to begin, the urging member pushes the paper holder means against the position alignment mechanism, so the position at which printing is to start is determined mechanically. This enables color deviation to be prevented. Moreover, disengaging the drive of the paper holder means after the printing of each color is completed causes the paper holder means to move back to a position of contact with the alignment mechanism. Also, use of a clutch provides reliable engagement and disengagement of the drive.

Further features of the invention, its nature and various advantages will be more apparent from the accompanying drawings and the following detailed description of the invention and the claims.

The drawings are not necessarily to scale.

DETAILED DESCRIPTION

Figure 5:
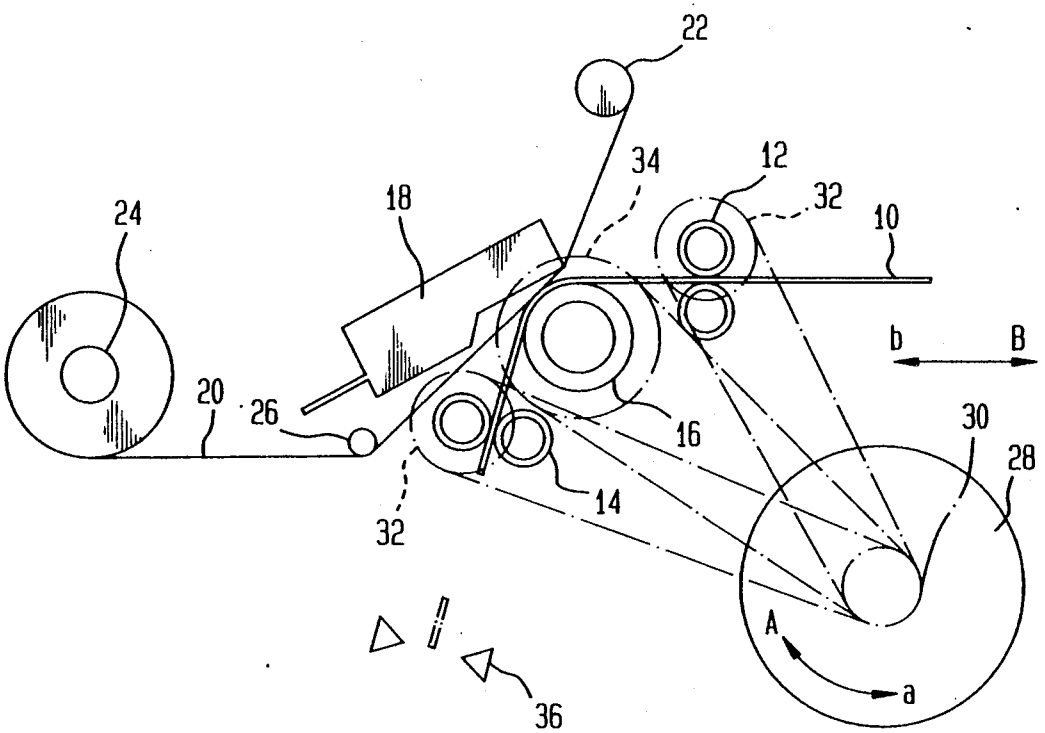
FIG. 5 (PRIOR ART)
FIGS. 5 shows a reciprocating paper transport mechanism and a paper position detection mechanism in a prior art color printer.

The invention will now be described with reference to FIGS. 1 and 2, which show a side view and a plan view, respectively, of the general configuration of a first embodiment of the color printer according to the present invention. Elements that are the same as those in the conventional arrangements shown in FIGS. 5 and 6 have been given the same reference numerals.

Figure 1:
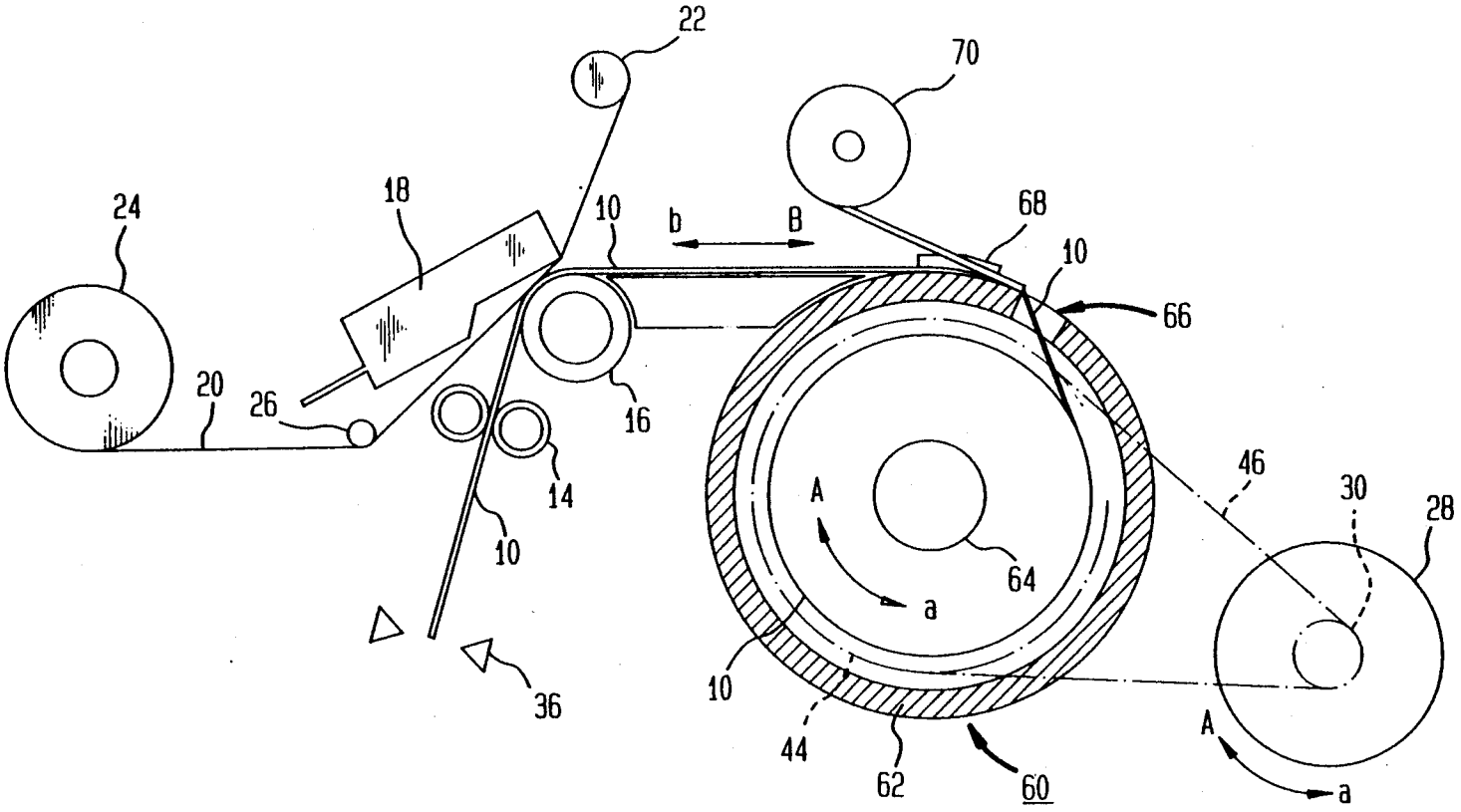
FIGS. 1 and 2 show a side view and a plan view, respectively, for a color printer in accordance with a first embodiment of the present invention.
Figure 2:
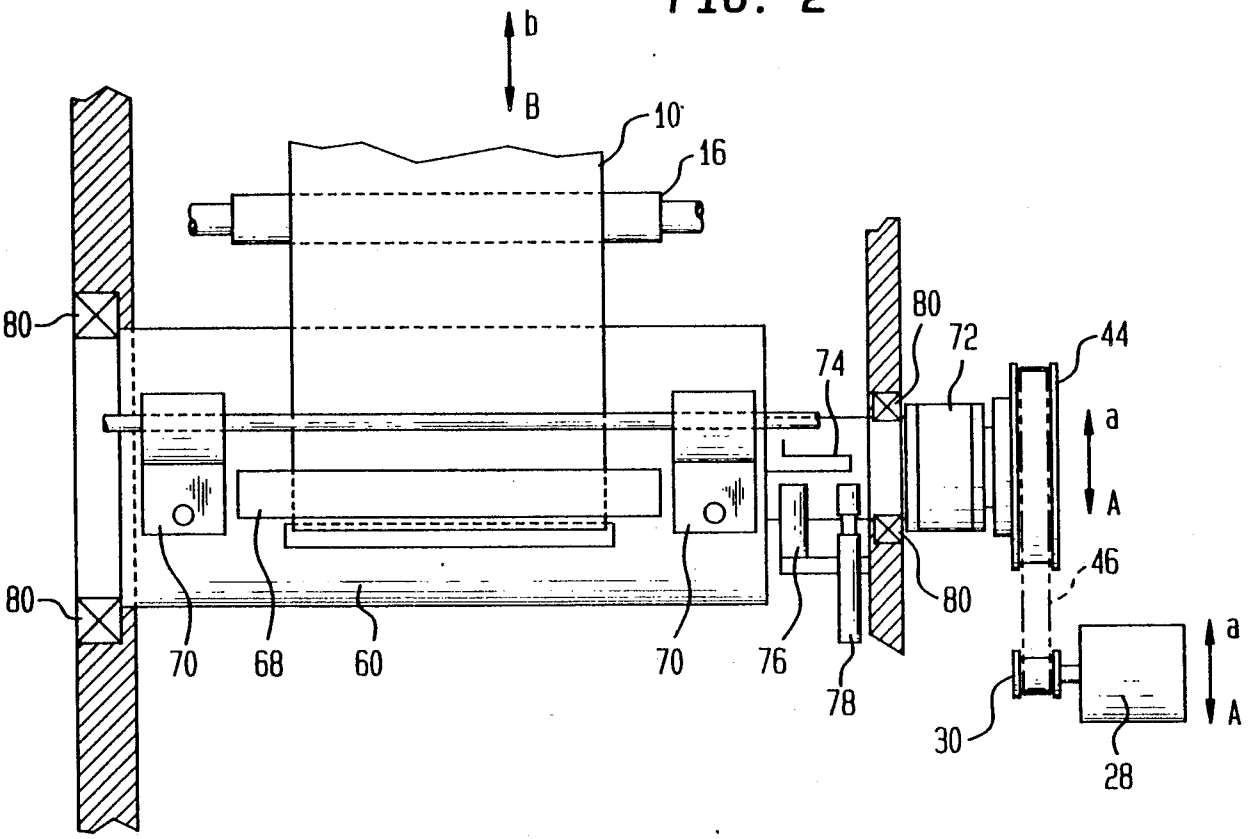

In FIGS. 1 and 2, a paper holder shaft 64 is arranged inside an outer wall 62 of hollow feed drum 60 concentrically with the drum 60. The paper 10 is provided in the form of a roll on the shaft 64, and a paper slit 66 is provided in the outer wall 62 of the feed drum 60.

In this embodiment, the paper 10 is drawn out onto the outer surface of feed drum 60, and is fed to the platen roller 16 and the pinch rollers 14. When the leading edge of the paper 10 is detected by an edge sensor 36, for example, a gripper 68 clamps the paper 10 against the outer surface of the feed drum 60. The paper 10 is thus supported by a paper holder means comprising the feed drum 60, the gripper 68 and the pinch rollers 14.

Figure 7:
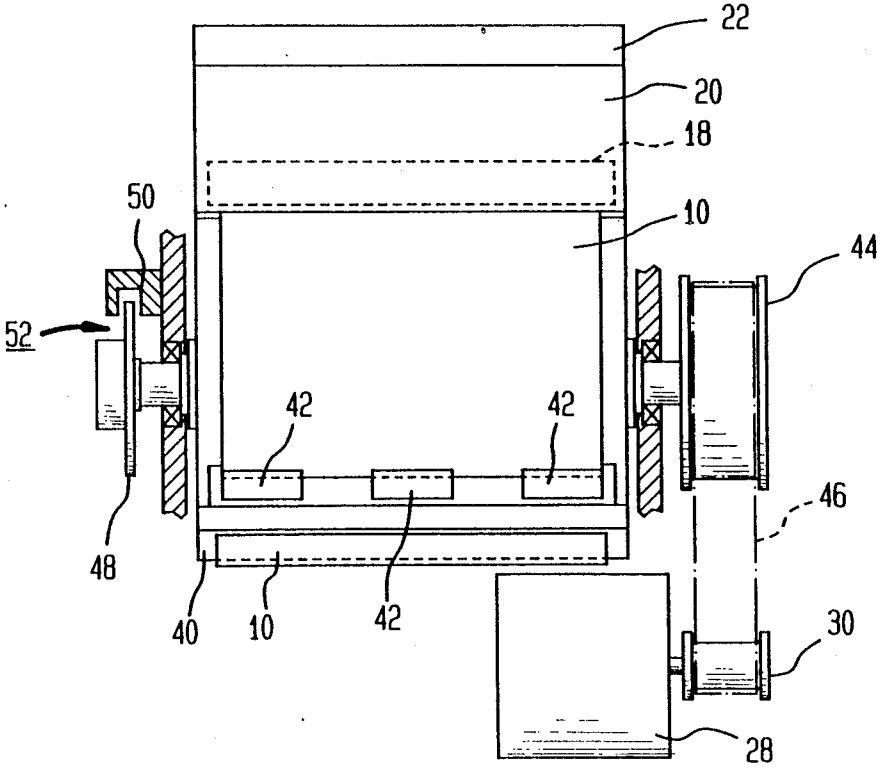
FIG. 7 (PRIOR ART)
FIGS. 6 and 7 show a side view and a front elevations, respectively, of a one-directional paper transport mechanism and a paper position detection mechanism in a prior art color printer.
Figure 6:
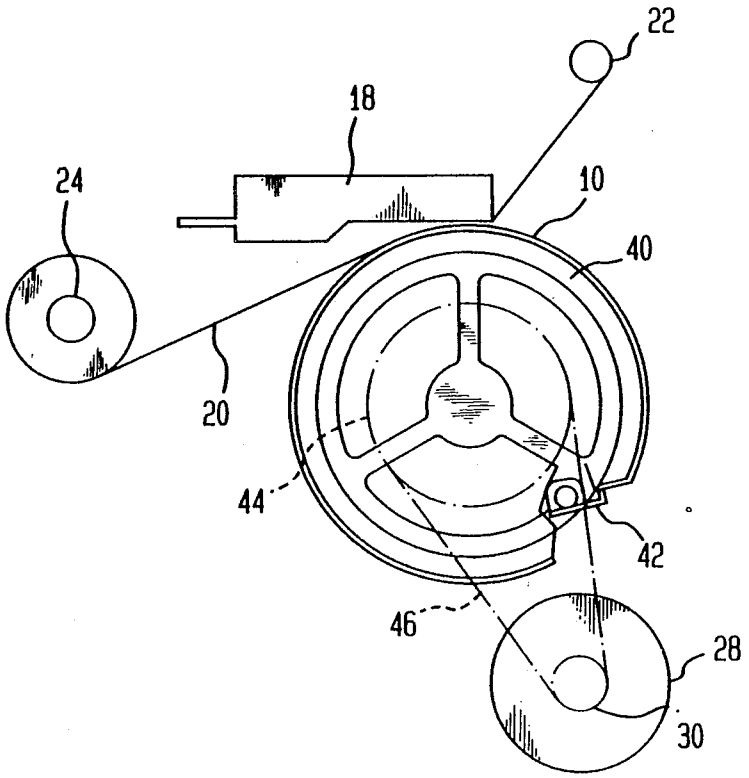
FIG. 6 (PRIOR ART)

Although the platen drum 40 described with reference to the prior art color printer of FIGS. 6 and 7 may be employed in the present invention, this first embodiment describes the use of the feed drum 60 for this purpose. An advantage of this arrangement is that a platen roller 16 of an optimum diameter in terms of print quality may be selected instead of the platen drum 40 of FIGS. 6 and 7, which drum 40 has to be of a large diameter to house the paper 10. Details of a color printer comprising this type of configuration are described in U.S. Pat. application Ser. No. 534,064, now U.S. 4,990,933, (entitled "Color Thermal Printer" and filed by the present assignee on June 6, 1990), which is incorporated herein by reference.

In FIG. 1, reference numeral 70 denotes fixed tension springs which form the urging member (that is a primary feature of the present invention); and as shown in FIG. 2, one of these springs is provided at each side of the feed drum 60. The fixed tension springs 70 exert a constant force on the feed drum 60 in a direction A that is opposed to the direction B of the printing.

In FIG. 2, reference numeral 72 denotes an electromagnetic clutch forming the disengaging means (that is a secondary feature of the present invention). When the motor 28 is rotated in a direction A, its driving force is transmitted to the feed drum 60, and when it is rotated in a direction a (in practice, not necessary), the driving force is disengaged. A spring-operated clutch may be used instead of an electromagnetic clutch.

A stop 74 provided on the drum shaft and a contact pin 76 provided on the side of the main printer unit constitute a positional alignment mechanism (that is third feature of the present invention). By means of this positional alignment mechanism, when the feed drum 60 is disengaged from the drive and is moved back against the urging force in a direction a, the position at which printing is to start on the paper 10 supported by the feed drum 60 (the paper holder means) is determined by contact between the stop 74 and the contact pin 76. A damper 78 is provided to absorb the shock of the impact between the stop 74 and the pin 76. The feed drum 60 rotates on a bearing 80.

The operation of the first embodiment will now be described. First, the paper 10 and the ink donor film 20 are fed between the thermal print head 18 and the platen roller 16. At this point the stop 74 of the feed drum 60 is pressed against the contact pin 76 by the force of the fixed tension springs 70.

When a command to print is received in this standby state, the thermal print head 18 presses the paper 10 and the ink donor film 20 against the platen roller 16. When the electromagnetic clutch 72 is then energized with the drum pulley 44 linked to the motor pulley 30, the rotation of the motor 28 turns the feed drum 60 in the printing direction A. This causes the paper 10, one end of which is clamped onto the feed drum 60 by the gripper 68, to be transported in the same direction, direction B. Also, the ink donor film 20, which is in close contact with the paper 10, is wound forward onto the film roller 22 in synchronization with the rotation of the feed drum 60.

When the feed drum 60 has been rotated by an amount corresponding to the required printing length of the first color in a color printing sequence, the motor 28 is stopped. When the motor 28 stops, the thermal print head 18 is released. This enables the paper 10 to move freely.

Next, when the electromagnetic clutch 72 is deenergized, the feed drum 60 is rapidly rotated in direction a by the fixed tension springs 70 to the print starting position. This is the position at which the stop 74 and the pin 76 come into contact. The shock of this contact is cushioned by the damper 78.

Meanwhile, the ink donor film 20 is wound forward to the second color to be printed. This cycle of operations is repeated by a number of times which correspond to the number of colors to be printed, such as three cycles for three colors, and so forth.

Since, in accordance with this embodiment, the stop 74 of the feed drum 60 presses against the contact pin 76 at the point where printing is to begin, the print starting position can be determined mechanically without employing an electrical position detecting means. As this prevents positional deviation arising from electrical detection positional error, it ensures a high degree of accuracy for the print starting position.

After completion of the printing of each color, the feed drum 60 rapidly retracts back to the print starting position. This helps to reduce the time required for the printing.

Figure 3:
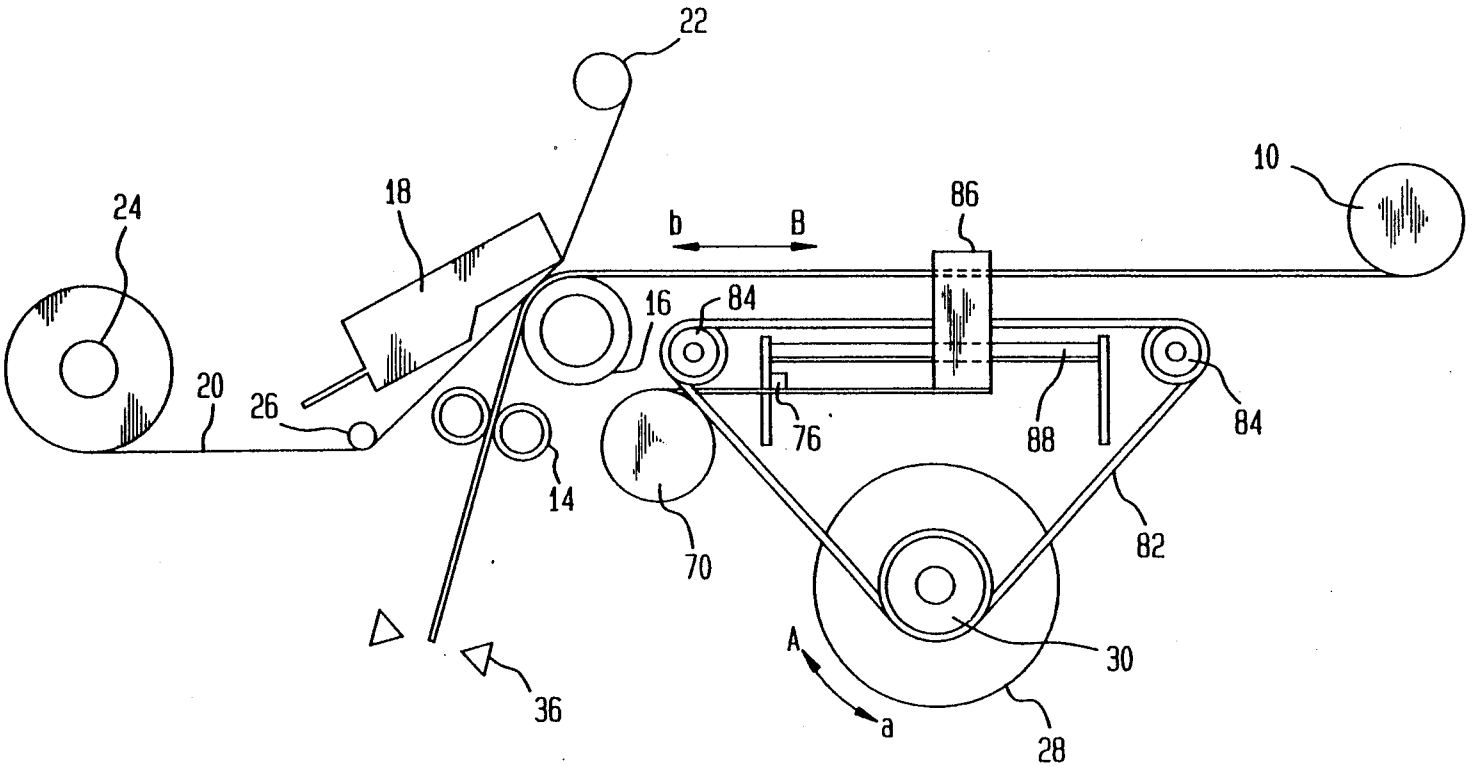
FIGS. 3 and 4 show a side view and a plan view, respectively, of a color printer in accordance with a second embodiment of the present invention.
Figure 4:
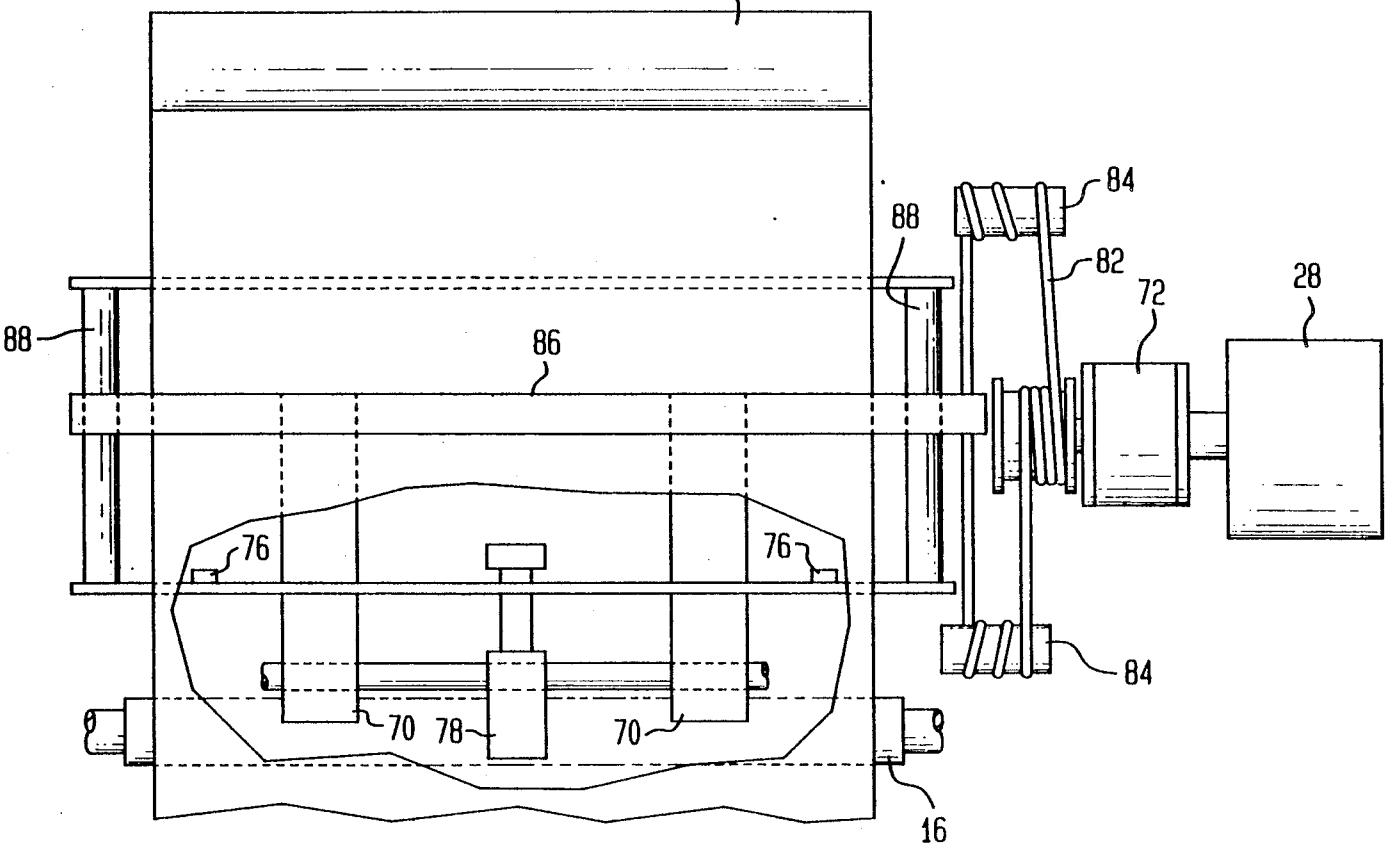

FIGS. 3 and 4 show a side view and a plan view, respectively, of a second embodiment of the present invention. Elements that are the same as those in the arrangement shown in FIGS. 1 and 2 have been given the same reference numerals. The color printer of this second embodiment uses the reciprocal transport system shown in FIG. 5.

In FIGS. 3 and 4, a drive wire 82 is wound a prescribed number of turns around the motor pulley 30, and after being wound several turns around each of the follower pulleys 84, the drive wire 82 is attached to the sides of gripper 86. As a result, rotation of the motor 28 in a direction A→a causes the gripper 86 (comprising the paper holder means) to move in a direction B→b. However, when the electromagnetic clutch 72 is disengaged, moving force in direction a is provided by the fixed tension springs 70 attached to gripper The print starting position is determined by the point at which the gripper 86 (urged in direction B) comes into contact with the contact pins 76. A damper 78 cushions the shock of this impact between the gripper 86 and the contact pins 76.

Operation of this second embodiment is the same as that of the first embodiment, so further details thereof are hereby omitted.

The urging member is not limited to a fixed tension spring 70. A screw recoil spring or tension coil spring may be used to obtain the same effect.

Thus, in the color printer of FIGS. 1–2 and 3–4 of the present invention, the position at which printing is to start is determined mechanically from the position of the paper holder means. This eliminates the need to detect this starting position and color deviation caused by positional detection error, and ensures a high degree of accuracy of the print starting position.

In addition, a clutch is used to provide reliable engagement and disengagement of the driving force, the paper holder means being moved in the printing direction by engaging the clutch and back to the print starting position by disengaging the clutch.

It is to be understood that the specific embodiments described herein are intended merely to be illustrative of the spirit and scope of the invention. Modifications can readily be made by those skilled in the art consistent with the principles of this invention.

What is claimed is:

1. A color printer comprising:

a print medium holder means which is freely movable in a prescribed printing direction while supporting a print medium;

a print transfer medium comprising a multiplicity of colored inks which are selectively brought into contact with, and separated from, the print medium supported on the print medium holder means; and printing means which is moved in unison with the movement of the print medium holder means while the print transfer medium is maintained in close contact with the print medium for effecting printing by selectively transferring the colored ink of the transfer medium to the print medium, the printing means comprising:

disengaging means for disengaging a driving force used to move the print medium holder means;

an urging member for urging the paper holder means in a direction opposite to the prescribed printing direction; and a positional alignment mechanism for mechanically determining the position at which printing is to start on the print medium using abutment contact of the print medium holder means when the holder means is disengaged from the driving force and is urged by the urging member in the direction opposite to the prescribed printing direction.

2. The color printer of claim 1 wherein the disengagement means is a clutch.

3. The color printer of claim 1 wherein the urging member is a spring.

4. The color printer of claim 3 wherein the urging member is a fixed tension spring.

5. The color printer of claim 3 wherein the urging member is a screw recoil spring.

6. The color printer of claim 3 wherein the urging member is a tension coil spring.

7. The color printer of claim 1 wherein:

the print medium holder means comprises a drum for supporting the print medium and a gripping means for clamping the print medium therebetween; an the positional alignment mechanism comprises a stop fixedly attached to the drum of the print medium holder means, and a contact pin fixedly mounted on the color printer which define the position at which printing is to start when the driving force is disengaged, the print medium is clamped by the gripping means, and the stop and the contact pin are in abutment contact.

8. The color printer of claim 7 wherein the urging member is a spring.

9. The color printer of claim 8 wherein the urging member is a fixed tension spring.

10. The color printer of claim 8 wherein the urging member is a screw recoil spring.

11. The color printer of claim 8 wherein the urging member is a tension coil spring.

12. The color printer of claim 1 wherein:

the print medium holder means comprises gripping means for clamping the print medium therebetween, and guiding means for supporting the gripping means; and the positional alignment mechanism comprises at least one contact pin fixedly attached to the guiding means of the print medium holder means which defines the position at which printing is to start when the driving force is disengaged, the print medium is clamped by the gripping means, and the contact pin and the gripping means are in abutment contact.

13. The color printer of claim 12 wherein the urging member is a spring.

14. The color printer of claim 13 wherein the urging member is a fixed tension spring.

15. The color printer of claim 13 wherein the urging member is a screw recoil spring.

16. The color printer of claim 13 wherein the urging member in a tension coil spring.

17. A color printer comprising:

a print medium holder means which is freely movable in a prescribed printing direction while supporting a print medium;

clutch means for disengaging a driving force used to move the print medium holder means;

an urging member for urging the print medium holder means in a direction opposite to that of the prescribed printing direction; and a positional alignment mechanism for mechanically determining the position at which printing is to start on the print medium when the print medium holder means is disengaged from the driving force and is urged in the direction opposite to that of the printing.

18. The color printer of claim 17 wherein the disengagement means is a clutch.

19. The color printer of claim 17 wherein the urging member is a spring.

20. The color printer of claim 17 wherein:

the print medium holder means comprises a drum for supporting the print medium and a gripping means for clamping the print medium therebetween; and the positional alignment mechanism comprises a stop fixedly attached to the drum of the print medium holder means, and a contact pin fixedly mounted on the color printer which define the position at which printing is to start when the driving force is disengaged, the print medium is clamped by the gripping means, and the stop and the contact pin are in abutment contact.

21. The color printer of claim 17 wherein:

the print medium holder means comprises gripping means for clamping the print medium therebetween, and guiding means for supporting the gripping means; and the positional alignment mechanism comprises at least one contact pin fixedly attached to the guiding means of the print medium holder means which defines the position at which printing is to start when the driving force is disengaged, the print medium is clamped by the gripping means, and the contact pin and the gripping means are in abutment contact.

* * * * *